US005576984A

United States Patent [19]

Cornejo

[11] Patent Number: 5,576,984

[45] Date of Patent: Nov. 19, 1996

[54] HYDRODYNAMIC BEARING ROTOR ORBIT SIMULATOR

[75] Inventor: Guillermo A. Cornejo, San Diego, Calif.

[73] Assignee: Solar Turbines Incorporated, San Diego, Calif.

[21] Appl. No.: 346,703

[22] Filed: Nov. 30, 1994

[51] Int. Cl.[6] ..... G06G 7/57

[52] U.S. Cl. ..... 364/803

[58] Field of Search ..... 364/801–803, 364/805–806, 578

[56] References Cited

U.S. PATENT DOCUMENTS

| | | | |
|---|---|---|---|
| 4,051,427 | 9/1977 | Kilgore et al. | 364/801 X |
| 4,267,734 | 5/1981 | Shima et al. | 364/801 X |
| 4,490,808 | 12/1984 | Jasmin | 364/802 |
| 4,737,928 | 4/1988 | Parl et al. | 364/801 X |
| 4,922,194 | 5/1990 | Gaussa et al. | 364/806 |
| 5,105,373 | 4/1992 | Rumsey et al. | 364/801 X |
| 5,394,346 | 2/1995 | Milsom | 364/801 X |

OTHER PUBLICATIONS

Instruction Manual—Model 304A Sinewave/Phase Shift Generator For Orbits–Trig—Tek Inc Of Anaheim, CA. Dated Jan. 21, 1991.

*Primary Examiner*—Tan V. Mai

*Attorney, Agent, or Firm*—Stephen L. Noe; Steven R. Janda

[57] ABSTRACT

An apparatus and method is provided for simulating a plurality of bearing orbits. The apparatus includes a first simulator for producing signals indicative of a first simulated bearing orbit; a second simulator for producing signals indicative of a second simulated bearing orbit; a control for varying the rotor journal position for each of the first and second simulated bearing orbits; a control for varying the orbit amplitude for each of the first and second simulated bearing orbits; and a control for modifying the rotor mode shape of the first and second simulated bearing orbits.

16 Claims, 6 Drawing Sheets

HYDRODYNAMIC BEARING ROTOR ORBIT SIMULATOR

TECHNICAL FIELD

The invention relates generally to an apparatus and method for simulating a hydrodynamic bearing rotor orbit, and more particularly to an apparatus and method for producing a signal having variable parameters for simulating characteristics of a hydrodynamic bearing rotor system.

BACKGROUND ART

In high speed rotating devices such as gas turbines, the vibration characteristics of rotating members play an important role in determining performance and expected life of the machine. To monitor these vibration characteristics, systems have been developed including a pair of Eddy current sensors mounted near each journal surface. The two Eddy current sensors are radially spaced from each other approximately ninety degrees around the circumference of the journal. As the rotating member rotates within the bearing, signals are produced in response to the changing proximity of the member to the Eddy current sensors.

The signals from the sensors are then studied to determine the vibrational characteristics of the particular bearing of interest. One convenient method of studying the vibrational characteristics is to display the signals from the two Eddy current sensors in a Lissajou plot. Using these plots, the designers or test personnel can easily determine the journal displacement amplitude or orbit magnitude of the member rotating within the bearing and the journal kinematic equilibrium position with respect to the geometric center of the bearing. Hence the Lissajou plots represent the actual motion of a journal within a bearing.

In the case of a rotor in a two bearing system in which signals from each bearing are being monitored simultaneously, the Lissajou plots are displayed to determine the relative phase of one orbit with respect to another which represents the mode shape of the rotational vibration of the system. The term mode shape refers to the deflection shape of the rotor when the rotor goes through the critical speed corresponding to the natural frequency of the system.

In the case of a rigid rotor, for example, the potential mode shapes include a bouncing mode and a conical mode. Orbits of the bouncing mode have their major axis in phase and points on the journals along the same axial reference move in phase. In contrast, orbits of the conical mode, while having their major axis in apparent phase, commit the points on the journals along the same axial reference to a one-hundred eighty degree out of phase motion.

Vibration monitors used in such studies must be tested to ensure proper calibration. Similarly, test personnel must be trained in the use of such vibration monitors and in the vibration characteristics of the machines on which they will be performing tests. To date, adequate devices have not been developed to simulate the journal displacement amplitude, the kinematic equilibrium position of a rotor within a bearing, and the mode shape for a rotor turning in a two bearing system.

The present invention is directed to overcoming one or more of the problems set forth above.

DISCLOSURE OF THE INVENTION

Lissajou display of fixed AC voltages and variable frequency signals is a well known concept. The present invention takes this concept beyond its well known aspect and expands it into the domain of rotor hydrodynamics orbit simulation. This is done by adding to the Lissajou phenomena amplitude control of AC signals and control of DC voltage magnitude and polarity. These voltages represent journal displacement amplitude or orbit magnitude and journal kinematic equilibrium position with respect to bearing geometric center within a bearing. The relative phase of one simulated orbit with respect to another orbit represents the mode shape of the system.

In one aspect of the invention, an apparatus for simulating a plurality of bearing orbits is provided. The apparatus includes a first simulator for producing signals indicative of a first simulated bearing orbit; a second simulator for producing signals indicative of a second simulated bearing orbit; a control for varying the rotor journal position for each of the first and second simulated bearing orbits; a control for varying the orbit amplitude for each of the first and second simulated bearing orbits; and a control for modifying the rotor mode shape of the first and second simulated bearing orbits.

In a second aspect of the invention, a method for simulating a plurality of bearing orbits is provided. The method includes the steps of simulating a first simulated bearing orbit; simulating a second simulated bearing orbit; controlling the rotor journal position for each of the first and second simulated bearing orbits; controlling the orbit amplitude for each of the first and second simulated bearing orbits; and controlling the rotor mode shape of the first and second simulated bearing orbits.

In yet another aspect of the invention, a method for simulating a plurality of bearing orbits is provided. The method includes the steps of producing signals indicative of a first simulated bearing orbit; producing signals indicative of a second simulated bearing orbit; controlling the rotor mode shape of the first and second simulated bearing orbits by phase modulating the signals indicative of the first and second simulated bearing orbits; producing a plurality of harmonics of the phase modulated signals; and summing the plurality of harmonics.

The invention also includes other features and advantages which will become apparent from a more detailed study of the drawings and specification.

BRIEF DESCRIPTION OF THE DRAWINGS

For a better understanding of the present invention, reference may be made to the accompanying drawings, in which.

BEST MODE FOR CARRYING OUT THE INVENTION

FIGS. 1*a* through 1*h* illustrate Lissajou plots of signals representative of the kinematics of a journal rotating in a hydrodynamic bearing. Typically, these plots are displayed on a cathode ray tube (CRT) display in a manner well-known in the art. While a Lissajou plot of two sinusoidal signals of identical frequency would be substantially elliptical in shape, as harmonics are added to the signals, the shape of the displayed Lissajou plot changes substantially. FIGS. 1*a*, 1*c*, 1*e*, and 1*g* illustrate forward whirling orbits having one, two, three, and four harmonics, respectively. FIGS. 1*b*, 1*d*, 1*f*, and 1*h* illustrate backward whirling orbits having one, two, three, and four harmonics, respectively. It should be understood that additional harmonics will cause additional minor orbits to be displayed on the Lissajou plots.

Figure 1A:
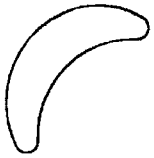
FIGS. 1*a* through 1*h* represent Lissajou plots of simulated bearing orbits having multiple harmonics and both forward and backward whirling.
Figure 1B:
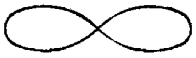
Figure 1C:
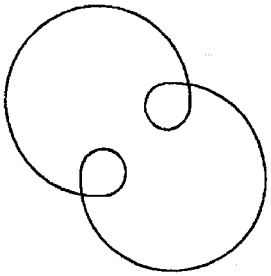
Figure 1D:
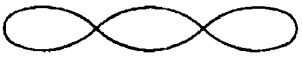
Figure 1E:
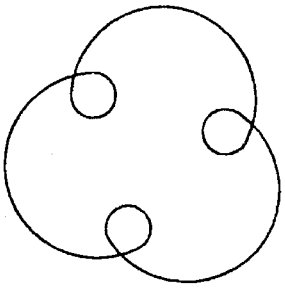
Figure 1F:
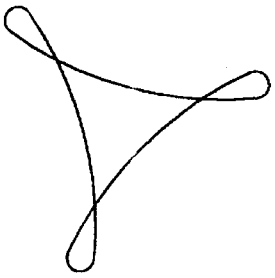
Figure 1G:
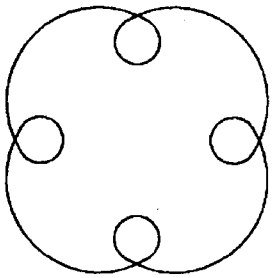
Figure 1H:
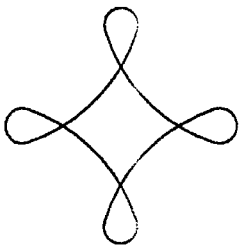
Figure 2A:
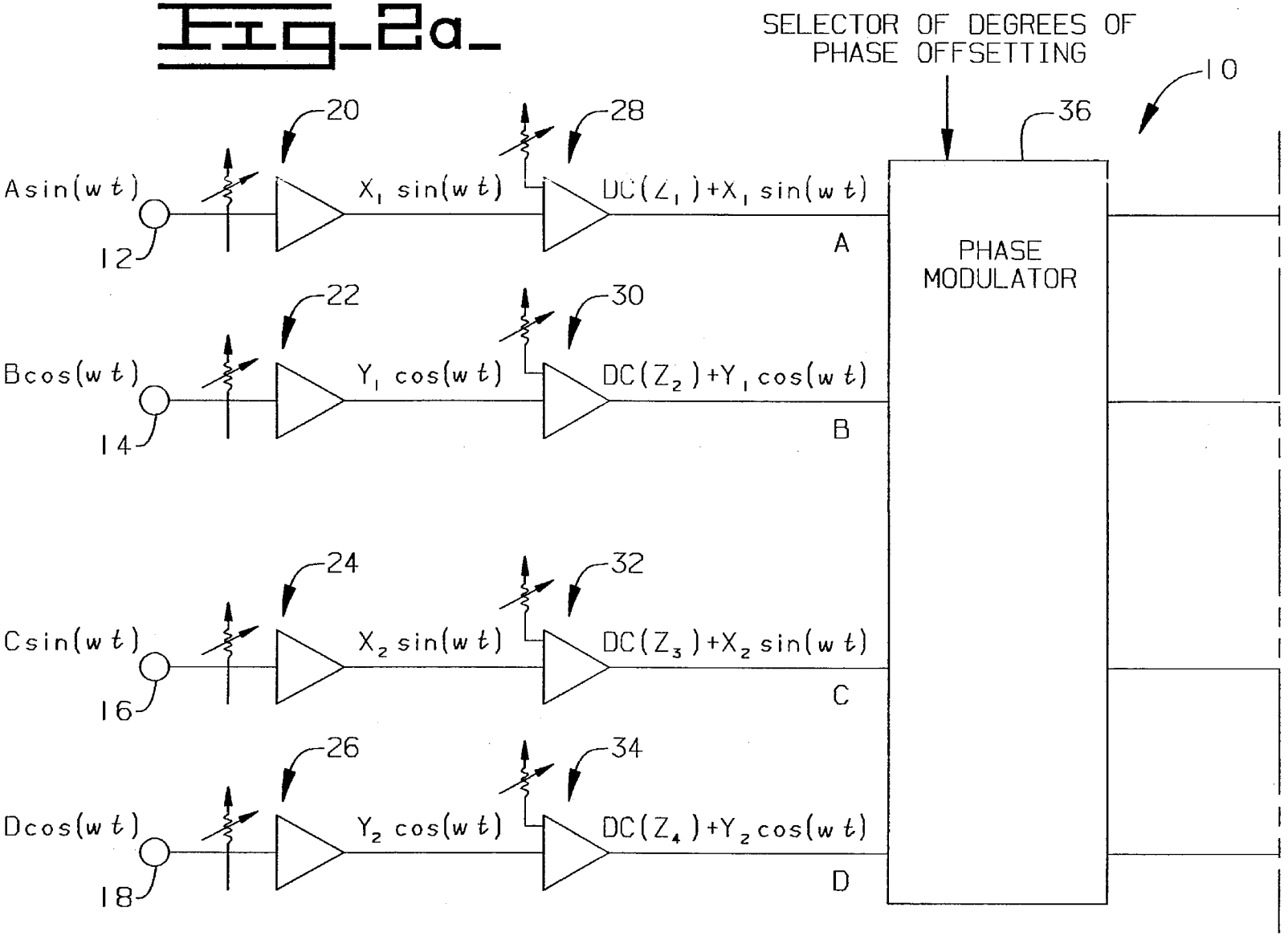
FIGS. 2*a*–2*b* are schematic diagrams of an embodiment of the invention.

In the present invention, the position of the center of the orbit with respect to the center of the CRT display and the size of the major orbit itself and of the smaller orbits is controlled by the electrical circuits described below in connection with FIGS. 2, 4, and 5. FIG. 2 illustrates a schematic of an embodiment of the present invention which is referred to generally by the number 10. Sinusoidal signals are provided at first, second, third and fourth inputs 12,14, 16,18. In the preferred embodiment the signals at the first and second inputs are produced by a first function generator (not shown) and are sinusoids that are ninety degrees out of phase. The pair of signals at the first and second inputs therefore simulate signals that would be received from a pair of Eddy current sensors radially spaced from each other ninety degrees around the circumference of a journal.

Similarly, the signals at the third and fourth inputs 16,18 are sinusoids ninety degrees out of phase and are produced by a second function generator. In the preferred embodiment, the first and second function generators (not shown) are Model 304A Sinewave/Phase Shift Generators available from Trigtek Inc. of Anaheim, Calif.

Level controls 20,22,24,26 are provided at each of the inputs to independently control the amplitude of the sinusoids being delivered to the inputs 12,14,16,18. The level controls 20,22,24,26 include potentiometers that allow the operator to manually adjust the peak-to-peak amplitude of each of the signals. The controllable peak-to-peak amplitude of the sinusoids allows the operator to simulate different journal displacement amplitudes or orbit magnitudes for each of the two orbits being simulated. In terms of the Lissajou plot, the controllable peak-to-peak amplitude allows the operator to change the magnitude of the major axis of the Lissajou plots.

The signals from the outputs of the level controls 20,22, 24,26 are delivered to DC offset summing amplifiers 28,30, 32,34. The DC offset summing amplifiers 28,30,32,34 are also connected to potentiometers that allow the operator to control the DC offset each of the signals. The controllable DC offset allows the operator to simulate different journal kinematic equilibrium positions with respect to bearing geometric center within each bearing being simulated. In terms of the Lissajou plot, the controllable DC offset allows the operator to change the relative position of the plot on the CRT display.

Figure 3A:
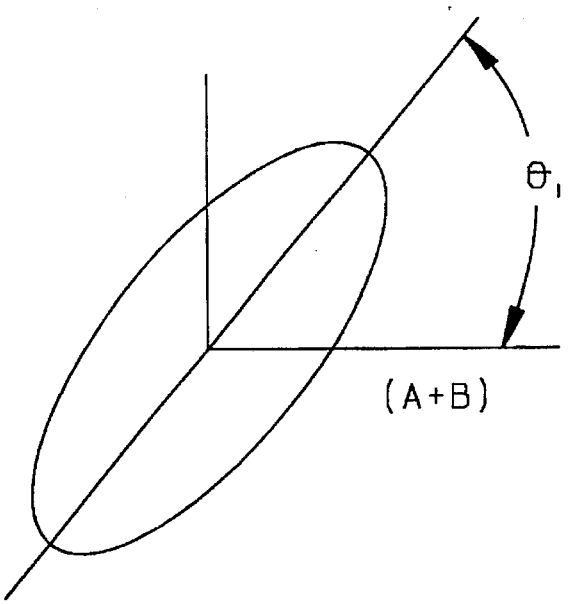
FIGS. 3*a*–3*b* illustrate the relative phase between Lissajou plots of a pair of bearings.
Figure 3B:
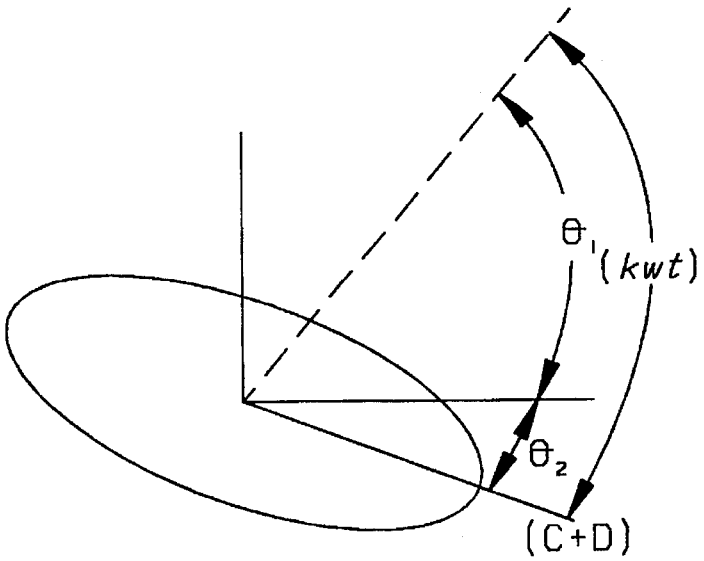

Each of the signals from the DC offset summing amplifiers 28,30,32,34 are delivered to a phase modulator 36. The function of the phase modulator 36 is best illustrated by reference to FIGS. 3*a* and 3*b*. FIG. 3*a* illustrates a Lissajou plot of sinusoidal signals A and B characterizing a first orbit and having a phase offset of $\theta_1$. FIG. 3*b* illustrates a Lissajou plot of sinusoidal signals C and D characterizing a second orbit and having a phase offset of $\theta_2$. The phase modulator 36 causes the value of $\theta_2$ to be shifted such that the second orbit has a phase offset by kwt with respect to the first orbit.

Figure 4:
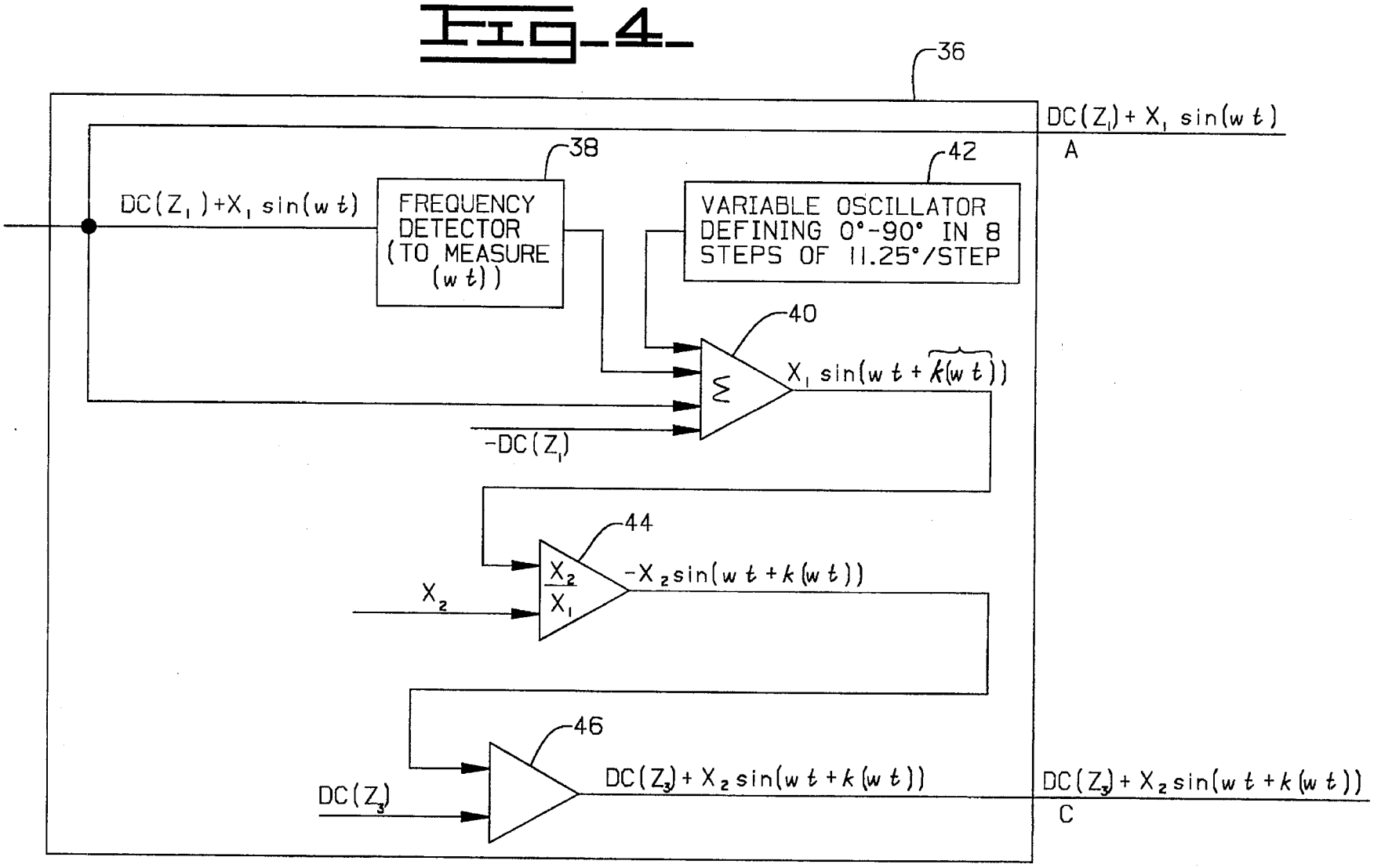
FIG. 4 is a schematic diagram of a phase modulator.

Turning now to FIG. 4, one-half of the circuitry of the phase modulator 36 is illustrated. The signal received at input A of the phase modulator is delivered directly to an output of the phase modulator 36 and also to a frequency detector 38 and a summer 40.

A variable oscillator 42 includes a rotary switch (not shown) having eight positions corresponding to eight discrete steps between zero and ninety degrees in equal eleven point two five degree increments. Each of the steps reflect a desired degree of phase shift between the two simulated orbits. The output of the variable oscillator, a sinusoidal signal having a frequency of kwt, where k represents the selected degree of phase offset, is delivered to an input of the summer 40. A signal having a level equal to the DC component of the signal at input A but with reversed polarity is obtained using DC level detection circuitry (not shown) of a type well-known in the art and is delivered to the summer 40 along with the output of the frequency detector 38. As will be understood by those skilled in the art, the summer 40 in practice is broken down into separate amplifiers handling each mathematical operation required to produce the output signal shown in FIG. 4.

The output of the summer 40 is delivered to an input of an AC amplitude multiplier/divider amplifier 44 along with a signal representative of the AC amplitude of the signal at input C that is obtained using AC amplitude detection circuitry (not shown) of a type well-known in the art. A signal indicative of the DC component of the signal at input C of the phase modulator 36 is added to the output of the AC amplitude multiplier/divider amplifier 44 to provide a signal output at output C of the phase modulator 36 which has the DC offset and AC amplitude of the signal at input C but which is phase shifted by kwt with respect to the signal at output A of the phase modulator 36.

The circuit associated with the signals at inputs B and D of the phase modulator 36 is identical to that disclosed in connection with inputs A and C. In the preferred embodiment, the outputs of the frequency detector 38 and the variable oscillator 42 are used commonly by both circuits.

Figure 2B:
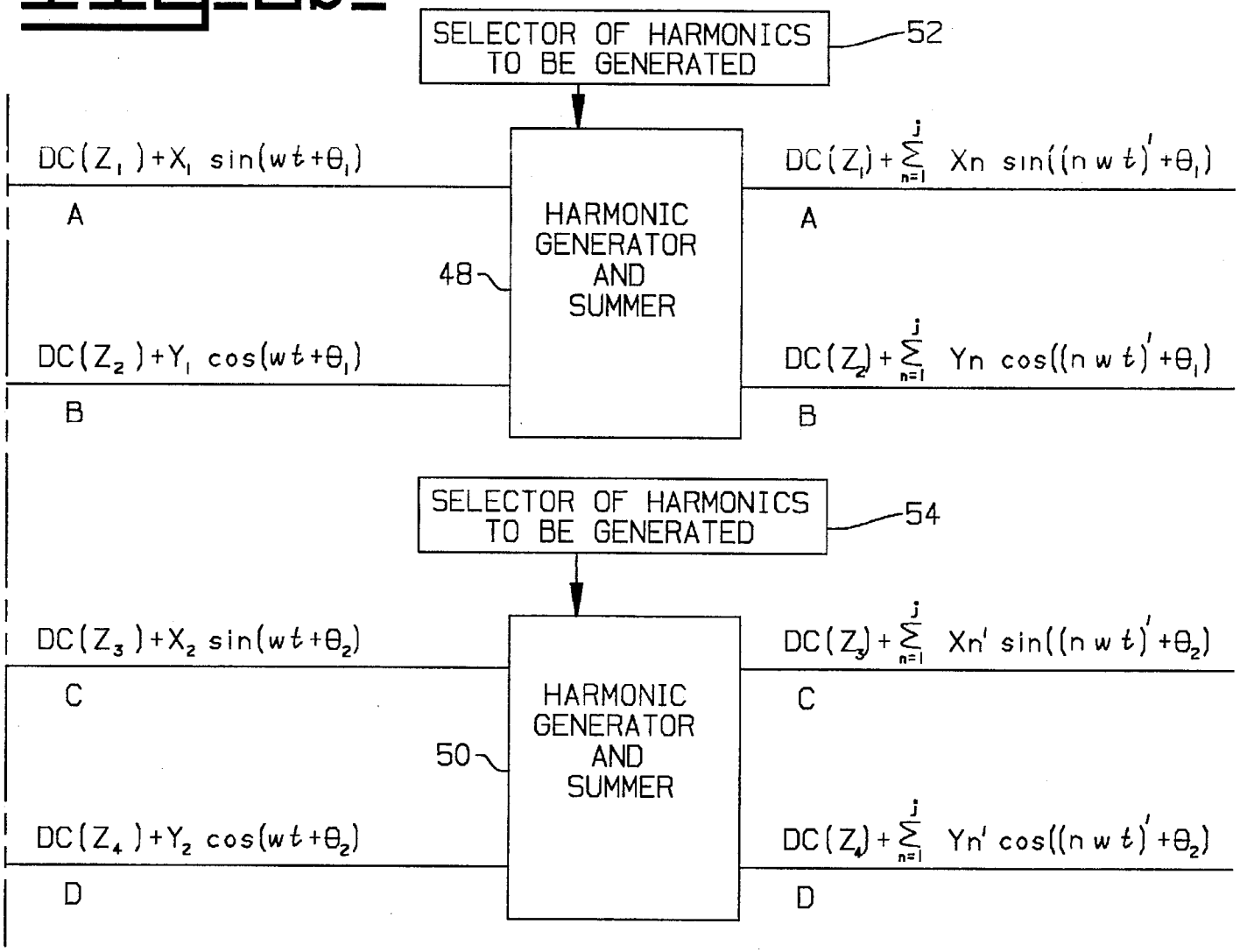

As shown in FIG. 2*b*, outputs A, B, C, and D of the phase modulator 36 are connected to first and second harmonic generators and summers 48,50. Selectors of harmonics to be generated 52,54 are connected to the first and second harmonic generators and summers 48,50. The selectors of harmonics advantageously include a plurality of switches for selecting each harmonic to be generated and summed. For example, in the preferred embodiment, the selectors of harmonics 52,54 each include eight individual switches for selecting any combination of the signals received from the phase modulator 36 and the second through eighth harmonics of the received signals. Since the signals on phase modulator outputs A and B represent a single bearing orbit, the harmonics selected for these signals are identical. Similarly, the signals on phase modulator outputs C and D represent a single bearing orbit and therefore the harmonics selected for these signals are also identical.

Figure 5:
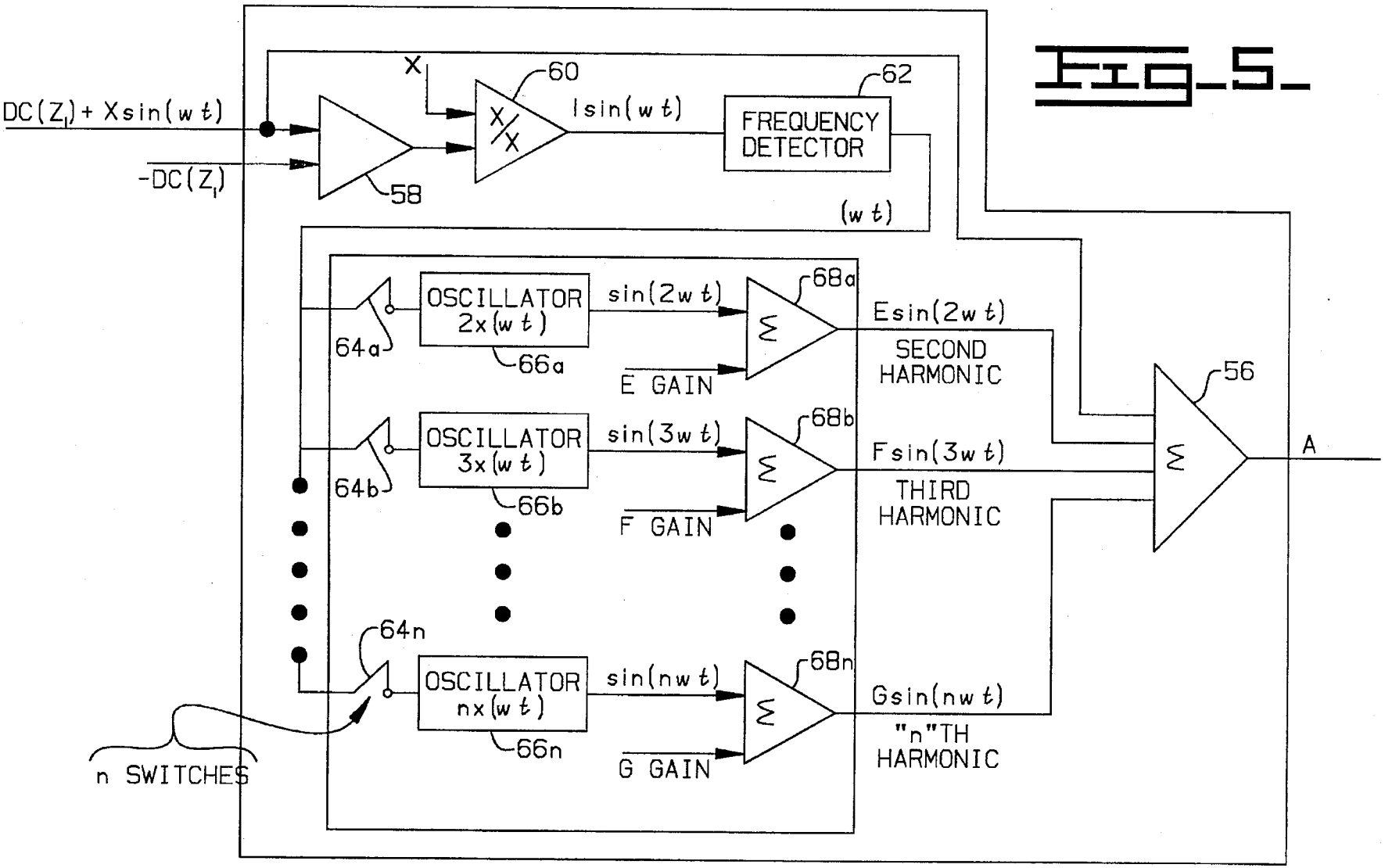
FIG. 5 is a schematic diagram of a harmonic signal generator and summing circuitry.

Turning now to FIG. 5, the harmonic generator and summer circuitry is illustrated. While only the circuit associated with output A of the phase modulator 36 is shown, it should be understood that the circuits associated with the other signals is identical to that shown. The signal received at input A of the harmonic generator is delivered directly to an input of a first summer 56 and also to a second summer 58. A signal having a level equal to the DC component of the signal at input A but with reversed polarity is also delivered to the second summer 58. The output of the second summer 58 is delivered to an input of a divider 60 together with a signal equal to the AC amplitude of the signal at input A. The output of the divider 60 is delivered to the input of a frequency detector 62. The frequency detector output, wt, is connected to each of a plurality of manual single pole, double throw switches 64. Each switch is associated with a particular harmonic of the frequency of the input signal. When each of the switches is closed, the output from the frequency detector is connected to an oscillator 66 for producing the associated harmonic. The oscillator 66 produces a sinusoidal signal having a frequency equal to a harmonic of the received signal, wt.

The outputs of the oscillators 66 are each delivered to a respective multiplier 68 at which a gain term is provided to the harmonic. Each of the gain terms is separately controllable by the operator using potentiometers (not shown). The controllable gain terms allow the operator to determine the shape of the overall orbit as shown in FIGS. 1*a* through 1*h*. The outputs from the multipliers 68 are delivered to the first summer 56 to produce output signal A. Thus, each of the switches closed by an operator of the invention will cause the associated harmonic to be added to the output.

While the harmonic generator and summers 48,50 have been described in connection with a single input and output, it should be understood that identical circuits are used for the three remaining inputs and outputs. The switches 64 are common for the inputs and outputs associated with each particular orbit. That is, one set of switches 64 is used for inputs and outputs A and B, and a second set of switches is used for inputs C and D. In the preferred embodiment, eight switches are provided for each simulated orbit corresponding to the input frequency and the second through eighth harmonics.

INDUSTRIAL APPLICABILITY

The orbit simulator is an electronic instrument used to simulate two hydrodynamic bearing rotor orbits by coupling Lissajou signals to a variable DC carrier and by making it possible to vary AC amplitude and frequency to simulate hydrodynamic bearing rotor system variables. Thus variables such as rotor kinematic equilibrium position as a function of speed and amplitude can be easily simulated. The rotor orbit simulator is used to develop and test vibration monitors which include rotor orbit monitoring among several of its features. The orbit simulator is also useful to train personnel in the specifics of rotor characteristics and to do rotor bearing troubleshooting.

A pair of DC coupled AC signals with a fixed phase at 90 degrees are used to simulate an orbit as it is sensed by a pair of XY non contact Eddy current probes that are physically positioned at 90 degrees with respect to the target journal surface. Two pairs of the same signals simulate two orbits. Variable DC voltage simulates rotor journal position within the bearings. Each orbit has an independent DC variable control.

For each orbit, the simulation of orbit amplitude is performed with an independent manual control of AC amplitudes. As explained above, simulation of rotor position, within a hydrodynamic bearing, to be controlled by independent manual control of DC voltage that carries the AC voltage components of the orbit signals.

The combination of two orbit simulations allows simulation of two bearing systems. The relative phase between the two simulated orbits are controlled to simulate different rotor mode shapes that are possible in a two bearing system.

Other aspects, objects, and advantages of this invention can be obtained from a study of the drawings, the disclosure, and the appended claims.

I claim:

1. An apparatus simulating a plurality of bearing orbits, the simulated bearing orbits including rotor journal position and amplitude, comprising:

first simulation means for producing signals indicative of a first simulated bearing orbit;

second simulation means for producing signals indicative of a second simulated bearing orbit;

means for varying the rotor journal position for each of the first and second simulated bearing orbits;

means for varying the orbit amplitude for each of the first and second simulated bearing orbits; and means for controlling the rotor mode shape of the first and second simulated bearing orbits.

2. An apparatus, as set forth in claim 1, including means for displaying Lissajou plots of the first and second simulated bearing orbits.

3. An apparatus, as set forth in claim 1, wherein the means for controlling the rotor mode shape includes means for controlling the relative phase between the orbits being simulated by said first and second simulation means.

4. An apparatus, as set forth in claim 3, including means for selecting the relative phase between the orbits being simulated by said first and second simulation means.

5. An apparatus, as set forth in claim 1, including a harmonic signal generator means for receiving phase modulated signals from said phase modulator means and responsively producing a plurality of harmonics of said phase modulated signals.

6. An apparatus, as set forth in claim 5, including summing circuitry for summing said plurality of harmonics of said phase modulated signals.

7. An apparatus, as set forth in claim 5, including a means for selecting the harmonics to be generated by said harmonic signal generator.

8. A method for simulating a plurality of bearing orbits, the simulated bearing orbits including rotor journal position and amplitude, comprising the steps of:

simulating a first simulated bearing orbit;

simulating a second simulated bearing orbit;

controlling the rotor journal position for each of the first and second simulated bearing orbits;

controlling the orbit amplitude for each of the first and second simulated bearing orbits; and controlling the rotor mode shape of the first and second simulated bearing orbits.

9. A method, as set forth in claim 8, including the step of displaying Lissajou plots of the first and second simulated bearing orbits.

10. A method, as set forth in claim 8, wherein the step of controlling the rotor mode shape includes the step of controlling the relative phase between the first and second simulated bearing orbits.

11. A method, as set forth in claim 10, including the step of selecting the relative phase between the first and second simulated bearing orbits.

12. A method, as set forth in claim 8, including the step of producing a plurality of harmonics of the first and second simulated bearing orbits.

13. A method, as set forth in claim 12, including the step of summing the plurality of harmonics of the first and second simulated bearing orbits.

14. A method, as set forth in claim 12, including the step of selecting the harmonics to be produced.

15. A method for simulating a plurality of bearing orbits, the simulated bearing orbits including rotor journal position and amplitude, comprising:

producing signals indicative of a first simulated bearing orbit;

producing signals indicative of a second simulated bearing orbit;

controlling the rotor mode shape of the first and second simulated bearing orbits by phase modulating the signals indicative of the first and second simulated bearing orbits;

producing a plurality of harmonics of the phase modulated signals; and summing the plurality of harmonics of the phase modulated signals.

16. A method, as set forth in claim 15, including the step of selecting the relative phase between the first and second simulated bearing orbits.

* * * * *